US006887354B2

(12) United States Patent
Karras et al.

(10) Patent No.: US 6,887,354 B2
(45) Date of Patent: May 3, 2005

(54) METHOD FOR APPLYING A COATING TO A LAMP AND COATED LAMP

(75) Inventors: Bernd Karras, Berlin (DE); Ursus Krüger, Berlin (DE); Uwe Pyritz, Berlin (DE); Raymond Ullrich, Schönwalde (DE)

(73) Assignee: SIEMENS Aktiengesellschaft, Munich (DE)

( * ) Notice: Subject to any disclaimer, the term of this patent is extended or adjusted under 35 U.S.C. 154(b) by 0 days.

(21) Appl. No.: 10/363,740

(22) PCT Filed: Sep. 7, 2001

(86) PCT No.: PCT/DE01/03502

§ 371 (c)(1),
(2), (4) Date: Sep. 11, 2003

(87) PCT Pub. No.: WO02/21559

PCT Pub. Date: Mar. 14, 2002

(65) Prior Publication Data

US 2004/0032210 A1 Feb. 19, 2004

(30) Foreign Application Priority Data

Sep. 7, 2000 (DE) ..... 100 45 544

(51) Int. Cl.[7] ..... G23C 14/34

(52) U.S. Cl. ..... 204/192.18; 204/192.1; 427/106; 427/107

(58) Field of Search ..... 204/192.1, 192.12; 427/106, 107

(56) References Cited

U.S. PATENT DOCUMENTS

| | | | | |
|---|---|---|---|---|
| 3,784,861 A | | 1/1974 | Notelteirs et al. | 313/117 |
| 4,661,233 A | | 4/1987 | Glasser | 204/298 |
| 4,802,968 A | | 2/1989 | Hendrix et al. | 204/298 |
| 5,539,393 A | * | 7/1996 | Barfod | 340/825.52 |
| 5,676,579 A | * | 10/1997 | Parham et al. | 445/58 |

FOREIGN PATENT DOCUMENTS

| | | | |
|---|---|---|---|
| DE | 36 01 010 | 7/1987 | C23C/14/26 |
| DE | 41 31 520 | 9/1992 | C23C/14/04 |
| DE | 42 01 551 | 7/1993 | H01J/37/34 |
| EP | 0 237 647 | 9/1987 | H01J/61/35 |
| WO | WO 98/48444 | 10/1998 | H01J/37/34 |

OTHER PUBLICATIONS

Database WPI Section EI, Week 200201 Derwent Publications Ltd., London, GB; AN 2002–000107 XP002188755 & CN 1 773 037 A (China Kinescope Co Ltd), Feb. 11, 1998.

"Handbook of Sputter Deposition Technology and Applications" von Kiyotaka Wasa, 1992 bei Noyes Publications, Fairview Ave. Westwood, New Jersey 07675 USA.

* cited by examiner

*Primary Examiner*—Steven Versteeg
(74) *Attorney, Agent, or Firm*—Young & Thompson

(57) ABSTRACT

A method for applying a coating (23) to a part of a surface of a lamp (20). The aim is to provide a simple manner of applying exact coatings to parts of surfaces with complicated designs. To this end, the lamp is vacuum-coated. The parts of the surface of the lamp (20) that are not to be coated are covered by a mask (3) and at least one coat is applied to the non-covered parts of the surface. The mask (3) is located at a predetermined distance (d) from the part of the surface of the lamp (20) and the mask (3) is oriented in relation to an illumination element (2) or a base (21) of the lamp (20). The invention also relates to a coated lamp that is produced according to a method of this type.

19 Claims, 2 Drawing Sheets

METHOD FOR APPLYING A COATING TO A LAMP AND COATED LAMP

CROSS REFERENCE TO RELATED APPLICATIONS

This is the 35 USC 371 national stage of international application PCT/DE01/03502 filed on Sep. 7, 2001 which designated the United States of America.

The invention relates to a process for applying a coating to a part-surface of a lamp. The invention also relates to a lamp which has been coated using a process of this type. The coating can be used to deliberately alter the light-emitting properties of the lamp. The coating can consist of light-absorbing or reflective material.

BACKGROUND OF THE INVENTION

For a process of this type, it is conceivable to use a drawing means, such as for a brush or a pen, to apply the coating direct to the part-surface of the lamp. However, this is complex and requires a relatively long time. Furthermore, there are problems with applying the coating with required degree of accuracy, for example if inaccurate production or assembly processes result in deviations from the normal shape of the part-surface, in particular if a bulb of the lamp is not oriented perpendicularly.

SUMMARY OF THE INVENTION

The invention is based on the object of providing a process which, in a simple way, allows the precise application of coatings to even a complicated shape of part-surface of lamps. This is to be possible even if the part-surface of the lamp deviates from its normal intended shape or position.

In a process of the type described in the introduction, this object is achieved, according to the invention, through the fact that vacuum coating of the lamp is carried out, in which surface parts of the lamp which are not to be coated are covered by a mask and at least one layer is applied to the uncovered part-surface, the mask being arranged at a predetermined distance from the part-surface of the lamp and the mask being oriented with respect to an illumination means or a cap of the lamp. In this context, it is particularly advantageous that given a suitably shaped mask it is possible to coat even a complicated shape of part-surface of the lamp.

The process according to the invention may be configured in such a manner that a mask whose shape matches the shape of the lamp is used. This advantageously makes it possible to ensure that the distance from the mask to the surface of the lamp is approximately equal for all part-surfaces of the lamp which are to be coated. As a result, the coating can be applied in a similar quality and with similar properties to all regions of the part-surface.

The process according to the invention can be configured in such a manner that a reactive sputtering process is used for the vacuum coating.

A reactive sputtering process can be used to produce layers which adhere to surfaces in a simple way. Furthermore, there is no need for a coating tool to touch the part-surface of the lamp in order to carry out the coating, and consequently the coating cannot cause any damage or alteration to the part-surface of the lamp or parts of the coating which have already been applied.

The material which is provided for the coating may advantageously be designed as a light-absorbing material. Coating with light-absorbing material makes it possible to have a targeted influence on the light which is radiated by the lamp.

According to the invention, the coating may consist of a pure metal. The metal used may in particular be iron, copper or zirconium. Furthermore, in the process according to the invention it is possible for at least one oxidic or nitridic metal compound to be applied as the coating. A metal compound of this type may in particular contain iron, copper or zirconium. The use of pure metals, such as for example iron, copper or zirconium, or of oxidic or nitridic metal compounds, such as for example oxidic or nitridic compounds of the abovementioned metals, makes it possible to apply thin coatings which adhere securely to part-surfaces of lamps and which have good light-absorbing properties as a function of the layer thickness.

The process according to the invention may also be configured in such a manner that the coating is built up from a plurality of layers which have been applied on top of one another. Building up the coating from a plurality of layers lying one above the other makes it possible to produce coatings with special properties since, by way of example, the properties of individual layers made from different materials can be combined with one another.

The process according to the invention may be configured in such a manner that the distance from the mask to the part-surface and the pressure which prevails during the vacuum coating are selected in such a way that the pressure-dependent mean free path length of the moving coating particles is greater than the distance from the mask to the part-surface. In this context, the term mean free path length of the moving coating particles is understood as meaning the path which the moving coating particles cover on average before they collide with another foreign particle which is in the very low-pressure gas (the vacuum) of the vacuum coating installation. There is an inversely proportional relationship between the pressure prevailing during the vacuum coating and the mean free path length.

If the distance from the mask to the part-surface and the pressure are selected as described above, it is ensured that a large proportion of the coating particles impinge on the part-surface of the lamp which is to be coated rather than colliding with foreign particles.

The invention is based on the further object of providing a lamp which has a coating which is applied in a simple way even in the case of part-surfaces of lamps which are of complicated design.

According to the invention, this further object is achieved by a lamp which has been coated using the process according to the invention, the coating being applied to part-surface of the lamp by means of vacuum coating with the lamp partially covered by a mask arranged at a distance from the part-surface of the lamp. A lamp of this type can bear exact coatings even on part-surfaces of complicated design.

According to the invention, the lamp can be configured in such a manner that the coating applied is strongly light-absorbing. This makes it possible to have a targeted influence on the light which is emitted by the lamp by suitably designing the shape of the part-surface and suitably selecting the thickness of the layer or layers to be applied.

According to the invention, the lamp may be configured in such a manner that the coating at least reduces the light emission from the lamp in at least one predetermined spatial angle. In this context, it is advantageous in particular that, depending on the design of the coated part-surface, certain spatial angles outside the lamp are illuminated less strongly.

The lamp according to the invention can advantageously be used in motor vehicles, in which case the coating reduces the dazzling effect. In order, for example, to ensure that the oncoming traffic is not dazzled, the coating may in this case be applied to the lamp in such a manner that when the lamp is installed in a headlamp of a motor vehicle, although light is emitted forward and also forward and to the right with respect to the direction of travel, it is not emitted forward and to the left, since light which is emitted in the direction forward and to the left of the driver could dazzle drivers of oncoming vehicles on this side.

BRIEF DESCRIPTION OF THE DRAWINGS

To further explain the invention.

DETAILED DESCRIPTION OF THE INVENTION

Figure 1:
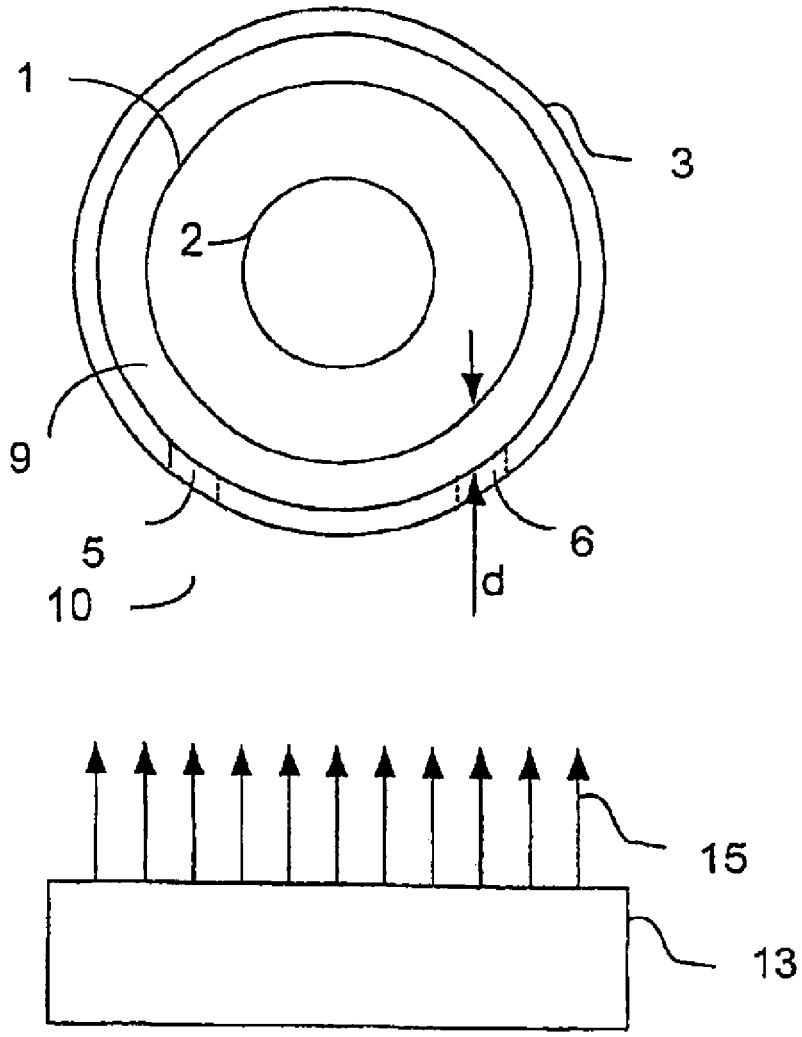
FIG. 1 shows an exemplary embodiment of a diagrammatic illustration of the process according to the invention.

FIG. 1 illustrates a plan view of the surface 1 of a substantially cylindrical lamp. In the context of the present description, the term the surface of the lamp is to be understood as meaning the light-transmitting surface through which the lamp radiates light. In the exemplary embodiment of a cylindrical lamp which is illustrated here, this surface is the lateral surface of the cylinder; this surface may also encompass an end face of the cylinder; however, this is not the case in the exemplary embodiment illustrated here. In this case, the surface is formed by the lateral surface of a transparent bulb made, for example, from glass, quartz glass, ceramic or plastic. In the interior of this bulb there is an illumination means 2, which is diagrammatically indicated as a circle in FIG. 1.

This illumination means may, for example, be a lamp light, an incandescent filament, a gas-discharge section or the gas fill of a fluorescent tube. The surface 1 of the lamp or the lamp bulb is surrounded by a mask 3 which encloses the lamp. The shape of the mask 3 is matched to the shape of the lamp. Since the lamp is cylindrical in shape, the mask is in the shape of a hollow cylinder which is slid over the cylinder of the lamp. The mask 3 has openings 5 and 6 which connect the space 9 between the surface 1 of the lamp and the mask 3 to the outside space 10 outside the mask 3.

Figure 3:
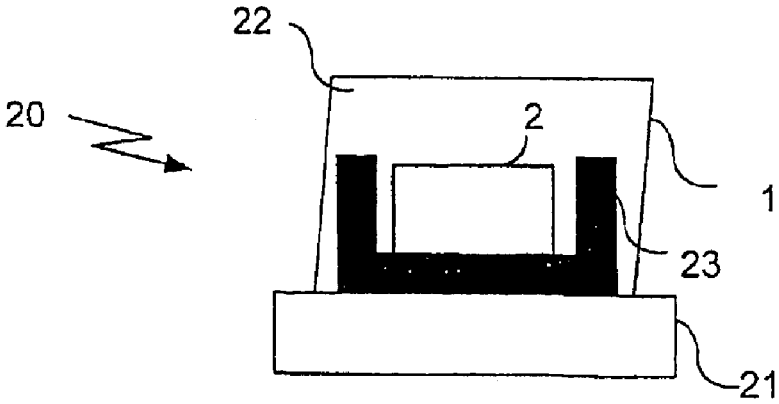
FIG. 3 shows an exemplary embodiment of a lamp which has been coated using the process according to the invention, in a view from the front.

The lamp bulb and the illumination means of the lamp are secured to a lamp cap, which is not illustrated in FIG. 1 for reasons of clarity (the lamp cap is illustrated in FIG. 3).

The lamp whose lamp bulb and illumination means are illustrated in FIG. 1 and the mask 3 which surrounds the lamp are located inside a vacuum coating installation. Only a target 13 of this vacuum coating installation is illustrated in FIG. 1. This target 13 represents the stock of a coating material with which the lamp is to be coated. Within the vacuum coating installation there is a vacuum, i.e. a gas which is at a very low pressure compared to the environment. In this exemplary embodiment, a sputtering process is to be used as the vacuum coating process.

Sputtering processes belong to the class of the PVD processes (PVD=Physical Vapor Deposition). In PVD processes, a material (which is in the form of a target) is removed from the target in vacuo by means of physical processes, e.g. vaporization or bombardment with high-energy particles. This material is then deposited on a surface located in the vicinity of the target. In the case of sputtering processes, the atomization of the target is carried out by means of high-energy particles, which may have energies of up to a few keV. The particles which have been removed from the target are deposited on the surface which is to be coated and form a layer.

More details on sputtering processes are to be found, for example, in "Handbook of Sputter Deposition Technology—Principles, Technology and Applications" by Kiyotaka Wasa, pub. 1992 by Noyes Publications, Fairview Avenue, Westwood, N.J. 07675, USA.

In FIG. 1, the target 13 is atomized by bombardment with high-energy particles in what is described as a reactive sputtering process. The coating particles which have been removed from the target move toward the lamp, with some coating particles being deposited on the surface of the mask 3, but other coating particles passing through the openings 5 and 6 in the mask, crossing through the space between the mask 3 and the surface 1 of the lamp and being deposited on the surface 1 of the lamp. The deposition of a sufficient number of coating particles results in the formation of a dense layer which bonds securely to the surface of the lamp. Since the coating particles move virtually parallel from the target to the lamp (as indicated by the parallel arrows 15), the openings 5 and 6 are projected onto the surface 1 of the lamp through the openings 5 and 6 in the mask 3. The result of this is that the projected surface of the openings onto the surface 1 of the lamp is coated with the material of the target 13. The projected surface represents the part-surface of the lamp which is coated. This takes place irrespective of how the surface of the lamp behind the openings is configured. By way of example, the surface may have production-related irregularities or defects, i.e. it may deviate from the ideal cylindrical shape. It is essential for the invention that the mask be oriented with respect to the illumination means 2 of the lamp and not with respect to the surface 1 of the lamp. In practice, the situation often arises whereby the illumination means, which must be in a precisely defined position, is oriented precisely with respect to a cap of the lamp, which is not illustrated in the figure. The lamp bulb is mounted on this lamp cap and then forms the surface 1 of the lamp. However, it is often impossible for the lamp bulb also to be positioned in a precise orientation with respect to the cap, but rather this lamp bulb is on occasion mounted skew on the lamp cap, so that the lamp bulb is not in the originally planned position with respect to the illumination means. If the lamp bulb were then to be used to define the position of the coatings which are to be applied (i.e. were the mask 3 to be oriented on the surface 1 of the lamp bulb), the result would be a coating which, although it would be arranged at the intended location with respect to the lamp bulb, would not be arranged at the intended location with respect to the illumination means. In many cases, however, there has to be a defined position between illumination means and coating.

If the position of the coating is oriented directly with respect to the illumination means or the lamp cap, a precise position of the coating with respect to the light-emitting illumination means is ensured even if the lamp bulb has not been positioned completely accurately. This is precisely what is achieved by the mask 3 which is oriented with respect to the illumination means. In detail, this is achieved by the mask 3 being oriented with respect to the lamp cap; as has been described above, this lamp cap has been oriented precisely with respect to the illumination means during assembly.

It is also possible for the position or arrangement of the illumination means to be determined with the aid of a position sensor (e.g. a camera) and for the information on the position of the illumination means obtained in this way to be used to orient the mask 3 with respect to the illumination means.

The use of the mask 3 which is at a distance "d" from the surface 1 of the lamp in the coating direction 15 and the orientation of the mask 3 with respect to the illumination means 2 of the lamp therefore makes it possible to coat the surface 1 of the lamp using the projection of the openings 5 and 6 in the mask onto this surface 1 of the lamp. As a result, disruptive influences resulting, for example, from an inaccurately aligned lamp bulb are avoided. In addition to the openings 5 and 6, the mask 3 also includes a further opening; however, this cannot be seen in the plan view illustrated in FIG. 1. The further opening 17 is illustrated, for example, in FIG. 2.

Vacuum coating processes, and in particular also sputtering processes, can be carried out at various pressures (i.e. therefore at different vacuum pressures). The lower the pressure in the vacuum vaporization installation, the fewer disruptive foreign particles per unit volume are present. Accordingly, the accelerated coating particles can cover a longer distance before colliding with any such foreign particles which are still present in low-pressure gases. The lower the pressure in the vacuum coating installation, therefore, the greater the mean free path length of the accelerated coating particles becomes. If the distance between the mask 3 and the surface 1 of the lamp is designed in such a way that this distance is shorter than the mean free path length of the particles, most particles reach the surface of the lamp and can be deposited thereon before colliding with the foreign particles. This allows effective coating of the lamp surface, for example it makes it possible to achieve a short coating time.

The coating process may also be configured in such a way that the distance between the mask 3 and the surface 1 of the lamp is greater than the mean free path length of the particles. As a result, some coating particles collide with foreign particles, and these coating particles are diverted out of their path (which is parallel to the path of the other coating particles) and may impinge on regions of the surface of the lamp which are not impinged on by coating particles which do not collide with foreign particles. This may lead to the formation of blurred edges at the coating boundary.

Vacuum coating processes and in particular sputtering processes can be used to apply light-proof, adhesion and scratch-resistant, temperature-stable and low-reflection coatings. Examples of materials to be coated which can be used include ceramic, glass, quartz, transparent plastics, such as for example Plexiglas, glass-ceramic, sapphire or polymers. The following coating materials or material combinations are particularly suitable examples for producing light-proof coatings for both ultraviolet light (UV light), visible light (VIS light) and infrared light (IR light): Fe, FeO, FeO/Fe/FeO, Cu, CuO, CuO/CuN, CuO/Cu/CuO, ZrO, ZrO/ZrN and ZrO/Zr/ZrO.

Figure 2:
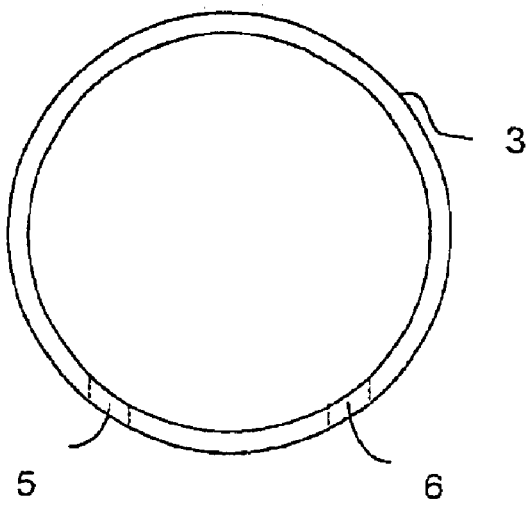
FIG. 2 shows an exemplary embodiment of a mask for the process according to the invention as seen from above and from the front.
Figure 2:
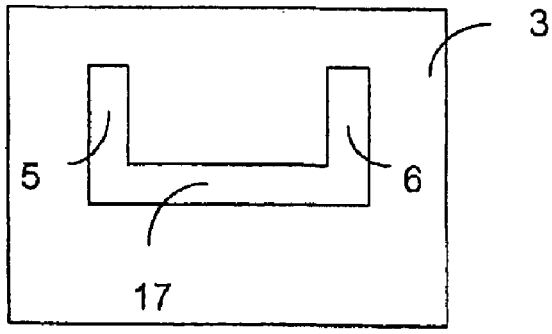

The top part of FIG. 2 shows the mask 3 which has already been illustrated in FIG. 1 in a view from above, while the bottom part of FIG. 2 shows the same mask 3 in a view from the front. The mask 3 has an opening in the form of a letter "U", with a yoke 17 and the two limbs 5 and 6 (the limbs 5 and 6 have been referred to as openings in FIG. 1 in order to improve understanding).

FIG. 3 illustrates a front view of a coated lamp 20. This lamp has an associated lamp cap 21, a lamp bulb 22 which forms the surface 1 of the lamp and an illumination means 2 arranged in the interior of the lamp bulb 22. A coating 23 has been deposited on the surface 1 of the lamp bulb through the U-shaped opening in the mask 3 by means of a PVD process (e.g. a sputtering process). In this exemplary embodiment, the layer is illustrated in black. The shape of the coating 23 corresponds to the shape of the U-shaped opening in the mask 3.

FIG. 3 also illustrates that the illumination means 2 is oriented precisely with respect to the lamp cap 21. The lamp bulb 22, however, has been secured in a skew position on the lamp cap 21 (for example as a result of production or assembly inaccuracies); therefore, the surface 1 and therefore also the part-surface of the lamp bulb which is to be coated are in a "skew" position with respect to the illumination means 2; the part-surface to be coated on the surface 1 therefore deviates from its normal shape. However, the coating 23 has been applied to the surface of the lamp bulb 1 in the intended position with respect to the illumination means 2, as symbolically indicated in the drawing 3 by the fact that the boundary lines of the applied layer are parallel to the contours of the illumination means 2. (The skew arrangement of the lamp bulb with respect to the surface 1 is not illustrated in FIG. 1).

The described process for applying coatings to part-surfaces of lamps therefore in particular has the advantage that securely bonded, scratch-resistant and temperature-stable coatings, which are arranged precisely with respect to the illumination means can be applied even to light-emitting surfaces of lamps which are in an incorrectly oriented position using a vacuum coating by means of a mask arranged at a distance from these light-emitting surfaces by exploiting the projection effect described above.

What is claimed is:

1. A process for applying a coating to a part-surface of a lamp, which comprises carrying out a vacuum coating of the lamp, wherein surface parts of the lamp which are not to be coated are covered by a mask, and at least one layer is applied to the uncovered part-surface, the mask is arranged at a predetermined nonzero distance from the part surface of the lamp (20), and the mask is oriented with respect to an illuminations means or a cap of the lamp.

2. The process as claimed in claim 1, wherein the mask used has a shape which is matched to the shape of the lamp.

3. The process as claimed in claim 1, wherein a sputtering process is used for the vacuum coating.

4. The process as claimed in claim 1, wherein light-absorbing material is applied as coating.

5. The process as claimed in claim 1, wherein elemental metal is applied as coating.

6. The process as claimed in claim 5, wherein the elemental metal used is iron, copper or zirconium.

7. The process as claimed in claim 1, wherein at least one oxidic or nitridic metal compound is applied as coating.

8. The process as claimed in claim 7, wherein iron, copper or zirconium is used as a constituent of the metal compound.

9. The process as claimed in claim 1, wherein the coating is built up from a plurality of layers applied on top of one another.

10. The process as claimed in claim 1, wherein the distance (d) from the mask to the part-surface and the pressure which prevails during the vacuum coating are selected in such a way that the pressure-dependent mean free path length of the moving coating particles is greater than the distance (d) from the mask to the part-surface.

11. A process for applying a coating to a surface of a lamp, comprising the steps of:

placing a mask around a lamp so that the mask covers parts of the lamp that are not to be coated, the mask being spaced apart from the lamp;

orienting the mask with respect to an illumination element of the lamp; and applying a coating to a surface of the lamp not covered by the mask.

12. The process as claimed in claim 11, wherein the coating is a vacuum coating applied using a sputtering process.

13. The process as claimed in claim 11, wherein the coating is a light-absorbing material.

14. The process as claimed in claim 11, wherein the coating is an elemental metal.

15. The process as claimed in claim 11, wherein the coating is at least one oxidic or nitridic metal compound.

16. The process as claimed in claim 15, wherein iron, copper or zirconium is used as a constituent of the metal compound.

17. The process as claimed in claim 11, wherein the coating is a plurality of layers applied on top of one another.

18. The process as claimed in claim 11, wherein a space between the mask and the surface, and a pressure applied during said applying a coating step are selected so that a pressure-dependent mean free path length of moving coating particles is greater than the space between the mask and the surface.

19. A process for applying a coating to a surface of a lamp, comprising the steps of:

placing a mask around a lamp so that the mask covers parts of the lamp that are not to be coated;

orienting the mask with respect to an illumination element of the lamp; and applying an elemental metal coating to a surface of the lamp not covered by the mask.

* * * * *